United States Patent [19]

Koizumi et al.

[11] Patent Number: 5,038,071

[45] Date of Patent: Aug. 6, 1991

[54] HEATER FOR INDIRECTLY-HEATED CATHODE

[75] Inventors: Sachio Koizumi, Mobara; Terutoshi Ichihara, Isumi; Toshio Kawashima, Chousel, all of Japan

[73] Assignee: Hitachi, Ltd., Tokyo, Japan

[21] Appl. No.: 317,590

[22] Filed: Mar. 1, 1989

[30] Foreign Application Priority Data

Mar. 7, 1988 [JP] Japan ..... 63-51479

[51] Int. Cl.[5] ..... H01J 1/22

[52] U.S. Cl. ..... 313/340; 313/270

[58] Field of Search ..... 313/340, 270, 337

[56] References Cited

U.S. PATENT DOCUMENTS

| | | | |
|---|---|---|---|
| 792,001 | 6/1905 | Callan | 313/340 |
| 3,119,897 | 1/1964 | Coper | 313/337 X |
| 3,691,421 | 9/1972 | Decker et al. | 313/340 X |

FOREIGN PATENT DOCUMENTS

| | | | |
|---|---|---|---|
| 1090774 | 10/1960 | Fed. Rep. of Germany | 313/340 |
| 2338178 | 2/1975 | Fed. Rep. of Germany | 313/340 |
| 0070656 | 6/1978 | Japan | 313/337 |
| 0012536 | 1/1984 | Japan . | |

*Primary Examiner*—Palmer C. DeMeo

*Attorney, Agent, or Firm*—Antonelli, Terry, Stout & Kraus

[57] ABSTRACT

In a heater for an indirectly-heated cathode having a double helical structure, a film which can be removed by heating at the temperature of 250° to 350° C. is disposed between adjacent portions in a vertical direction, of a helical core wire coated with an insulating layer. Since this film is disposed, the occurrence of cracks in the insulating layer can be prevented so that the insulating property between the heater and a cathode sleeve do not gel deteriorated and clogging of an electron beam aperture of a shadow mask can be prevented, too.

7 Claims, 2 Drawing Sheets

HEATER FOR INDIRECTLY-HEATED CATHODE

BACKGROUND OF THE INVENTION

This invention relates to a heater for an indirectly-heated cathode for a cathode-ray tube (CRT) and more particularly to the structure of a heater for an indirectly-heated cathode which avoids damage to an insulating layer that covers the heater in a heater of a double helical structure.

As disclosed, for example, in Japanese Patent Laid-Open No. 12536/1984, heaters for an indirectly-heated cathode for CRTs generally have the structure wherein a core wire made of a refractory metal containing, for example, tungsten as its principal component is shaped in the form of a helical coil by a mandrel having a circular section.

FIG. 2 of the accompanying drawings illustrates a heater 1 for an indirectly-heated cathode having a double helical structure in accordance with the prior art. Reference numeral 2 represents a heater core wire made of a refractory metal containing tungsten as the principal component. As shown in FIG. 3, this heater core wire 2 itself may have a structure in the coil-like form and the heater core wire to be described hereinafter includes the core wires of this structure, also. Reference numeral 3 represents a known insulating layer which is formed on the heater core wire 2. An insulating layer made of alumina is deposited on the core wire 2 and there is formed thereon a layer consisting of a mixture of tungsten particles and alumina particles and having large thermal emissivity. Then, the layer is sintered in a hydrogen atmosphere at 1,650° C., for example, to provide the insulating layer 3. Reference numeral 4 represents cracks of the insulating layer.

According to the prior art technique described above, the insulating layer 3 is likely to be damaged due to its brittleness. For example, when the heater 1 is put into or taken out from a container for transferring or when the legs of the heater 1 (the portions where the heater core wire 2 is exposed in FIGS. 2 and 3) are welded to a support portion of an electron gun structure, stress concentrates on the head of the heater (the opposite side to the legs) and cracks 4 are likely to develop in the insulating layer 3, as shown in FIG. 2. This stress is tensile stress due to impact or bending stress and torsional stress due to bending.

If such cracks 4 develop in the insulating layer 3 of the heater 1, the heater core wire 2 is exposed and when the heater 1 is incorporated in the cathode, insulation characteristics between the cathode heater 1 and the cathode 5 (including a cathode sleeve 21, a cap 22 and an electron emissive material 23 shown in FIG. 4 which is a sectional view of the principal portions) get deteriorated so that there occurs such problem that video signals of the CRT get distorted and picture quality drops. Furthermore, there also occurs the problem that particles falling off from the insulating layer 3 enter electron beam apertures of a shadow mask and clog them. This also results in a drop of picture quality. This tendency is all the more remarkable particularly in a high precision color picture tube having smaller electron beam apertures of the shadow mask than those of ordinary CRTs.

SUMMARY OF THE INVENTION

In view of the problems with the prior art technique described above, the object of the present invention is to provide a heater for an indirectly-heated cathode which avoids any damage to the insulating layer of a heater by the transferring work, the welding work, etc, described above and which has high reliability.

The object of the invention described above can be accomplished by forming a film, which can be removed by heating, at least between the adjacent portions (the adjacent portions in a vertical direction) of a helical core wire coated with an insulating layer in a double helical structure wherein the heater core wire is coated with the insulating layer.

The term "vertical direction" described above represents the direction which extends from the head to the legs of the double helical structure or the direction which extends from the legs to the head, and is represented by the direction 20 in FIG. 1*a*. Therefore, the heater for an indirectly-heated cathode in accordance with the present invention is characterized in that a film which can be removed by heating is formed between the adjacent portions in the vertical direction of the helical heater core wire coated with the insulating layer (hereinafter referred to as the "coated wire"), that is, between the adjacent portions in the direction 20 (hereinafter referred to briefly as the "adjacent portions").

The film which can be removed by heating is from 3 μm to 50 μm thick. If the film thickness is below this range, mechanical strength is insufficient and if it is above this range, there is the risk that the film cannot be removed sufficiently by heating.

Heating at the sealing step for welding the stem of the electron gun structure to the neck of CRT is generally utilized for heating for removing the film described above and the heating temperature is from 250° to 350° C. with the heating time ranging from 2 to 4 minutes.

The material forming the film to be formed between the adjacent portions of the coated wire may be of any type so long as it can be removed under the heating conditions described above but an organic resin or a material containing the organic resin as the principal component is used generally because the film can be formed easily between the adjacent portions. Examples of such an organic resin include nitrocellulose or a resin containing nitrocellulose as its principal component, polyvinyl alcohol or a resin containing PVA as its principal component, and an acrylic resin obtained by polymerizing a methylester methacrylate, benzoyl peroxide and methyl ethyl ketone or a resin consisting of the acrylic resin.

Incidentally, the film formed between the adjacent portions of the coated wire is generally also formed on the surface of the coated wire described above.

If the film is formed at least between the adjacent portions of the helical coated wire of the cathode heater of the double helical structure, the gap between the adjacent portions of the helical coated wire can be kept as such by the film.

Accordingly, even if any force is applied from outside, no variance develops between the adjacent portions of the coated wire so that any peculiar compressive stress, bonding stress, torsional stress, and the like does not occur in the heater and hence no cracks develop in the insulating layer of the heater.

The heater for an indirectly-heated cathode in accordance with the present invention may use the conventional structure except that the film is formed between the adjacent portions of the coated wire.

DESCRIPTION OF THE PREFERRED EMBODIMENTS

Figure 1B:
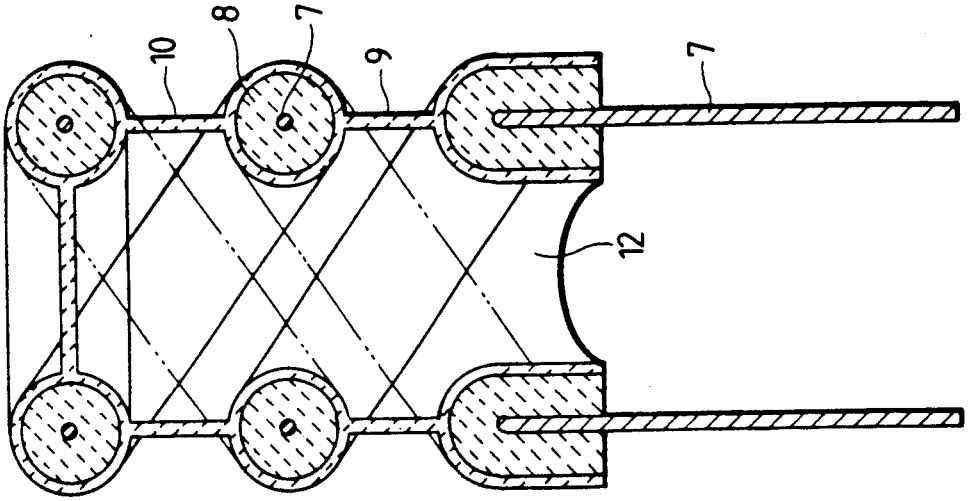
FIG. 1*b* is a longitudinal sectional view of the heater for an indirectly-heated cathode in the embodiment of the present invention.
Figure 1A:
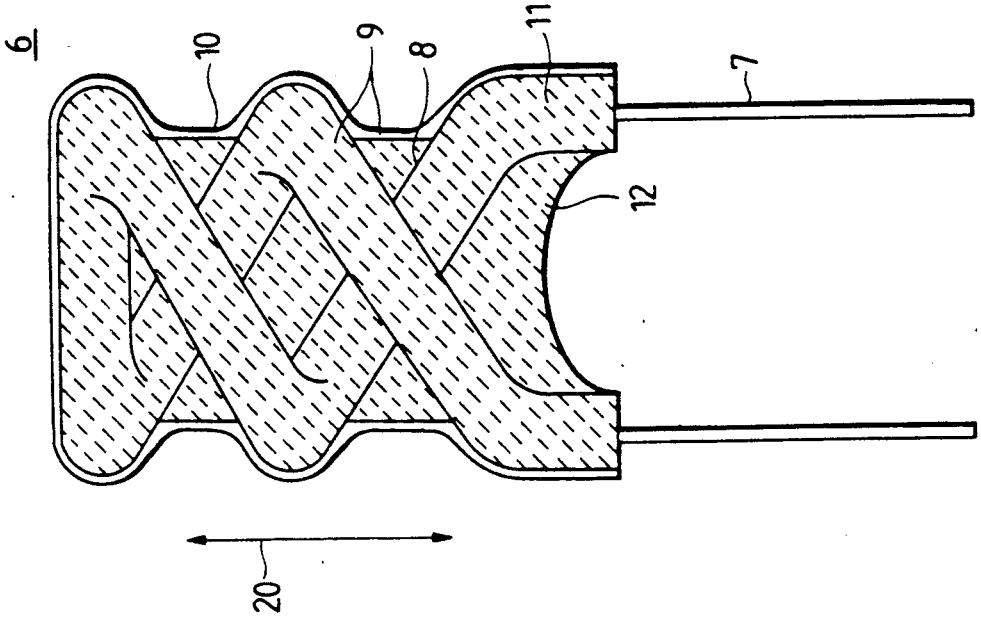
FIG. 1*a* is a front view showing a heater for an indirectly-heated cathode in accordance with one embodiment of the present invention.
Figure 2:
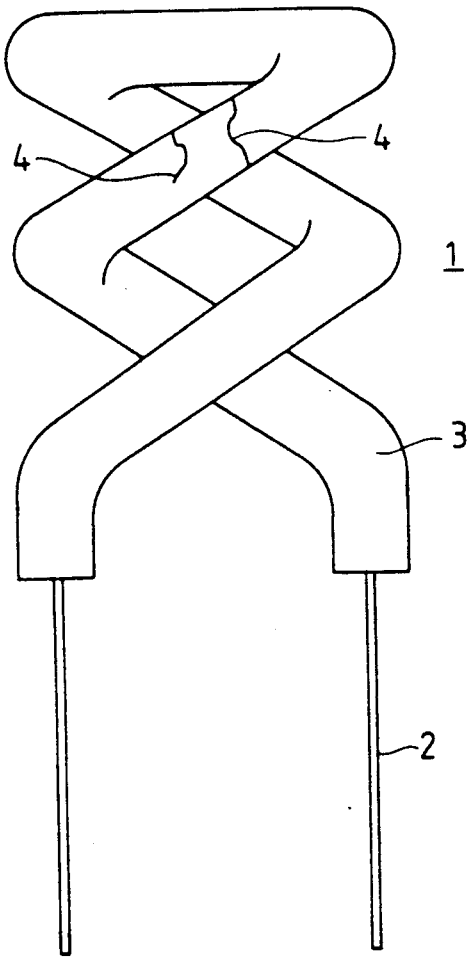
FIG. 2 PRIOR ART
FIGS. 2 and 3 are front views each showing a heater for an indirectly-heated cathode in accordance with the prior art.
Figure 3:
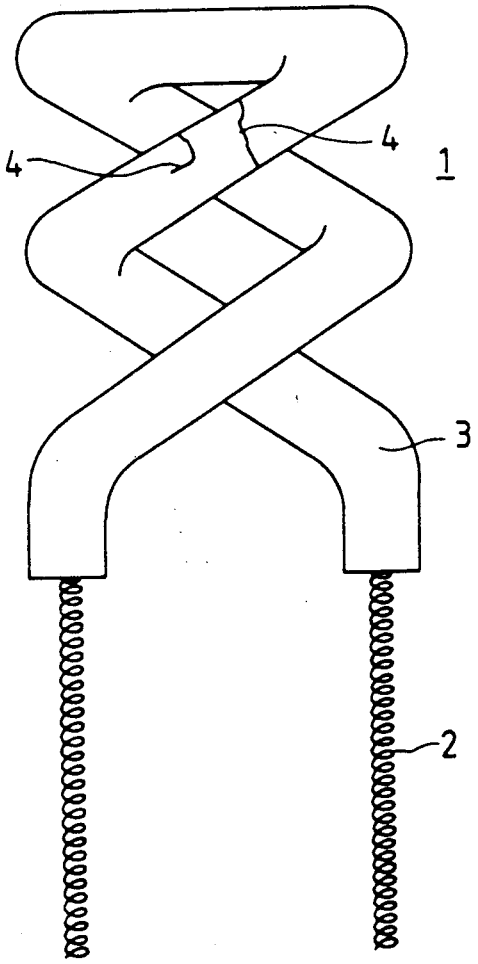
FIG. 3 PRIOR ART

Hereinafter, an embodiment of the present invention will be described with reference to FIGS. 1*a* and 1*b*. FIG. 1*a* is a front view showing the appearance of a heater 6 for an indirectly-heated cathode having a double helical structure in accordance with the present invention and FIG. 1*b* is its longitudinal sectional view. Reference numeral 7 represents a heater core wire made of tungsten and reference numeral 8 represents an insulating layer. This layer is formed as well known by forming an alumina layer on the heater core wire 7, then coating a layer having large thermal emissivity such as a layer of the mixture of alumina particles and tungsten particles, for example, and sintering it in a high temperature hydrogen atmosphere at 1,650° C., for example. The present invention is characterized in that a film 9 which can be removed by heating is formed at least between the vertically adjacent portions of the helical coated wire of the cathode heater 6 having the double helical structure which is coated by the insulating layer 8 described above.

Besides tungsten described above, refractory metals such as tungsten containing additives and molybdenum, which are generally used for heaters, can be employed for the heater core wire.

The film 9 is formed in the following way. Nitrocellulose is dissolved in methyl isobutyl ketone to prepare an approx. 10 wt % solution and the heater 6 having formed the insulating layer 8 thereon is dipped into this solution, pulled out therefrom and dried. In this manner the heater having the double helical structure is coated as a whole with the film 9 and the film having a curtain-like section 10 is formed between the adjacent portions of the double helical coated wire. This curtain-like film 9 is approximately from 5 to 15 μm thick and keeps the gap between the adjacent portions of the helical coated wire of the double helical structure as it is with suitable strength. If the film 9 is formed to the portion 12 bridging the legs 11 of the heater 6, too, a greater effect can be obtained.

Incidentally, the curtain-like section 10 in FIG. 1*a* is illustrated particularly for the purpose of explanation. Two-dot chain lines connecting obliquely the coated wires in FIG. 1*b* represent the profile of the helical coated wire on the foreground side in order to have the heater structure more easily understood.

Figure 4:
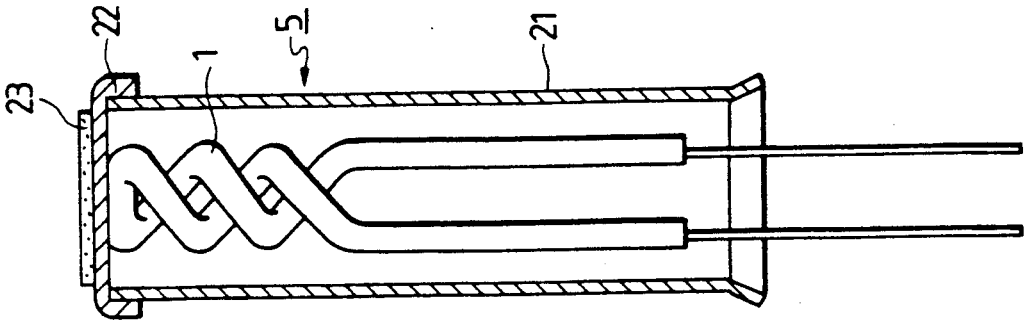
FIG. 4 is a sectional view of the principal portions of the indirectly-heated cathode.

After the film 9 is formed between the adjacent portions of the helical coated wire in the manner described above, the heater 6 is inserted into the cathode 5 described above and shown on FIG. 4 and is further assembled integrally with the electron gun to constitute an electron gun structure. This electron gun structure is disposed at the neck portion of the CRT and the stem of the electron gun structure and the neck portion of the CRT are heated and welded at the sealing step.

In this instance, the heater 6 is heated to the temperature of 250° C. to 350° C. for 2 to 4 minutes at the sealing step and the film 9 formed on the heater 6 is almost all decomposed and evaporated and discharged outward through an exhaust tube of the stem at the sealing step. Even if a trace amount of film remains on the heater 6, the remaining film, too, is evaporated completely upon turn-on of the heater of the CRT. After all, the cathode heater 6 of the present invention has exactly the same structure as that of the conventional cathode heater after it is assembled in the CRT, and operates in the same way.

As described above, the film 9 formed on the heater 6 may be of such a type which is decomposed, evaporated and removed at the sealing step or by heating at 250° C. to 350° C. for 2 to 4 minutes. Generally, a film containing an organic resin as its principal component can be used suitably. For example, a 5 wt % solution prepared by dissolving polyvinyl alcohol in pure water can be used as the solution for forming the film 9. The same result can be obtained by use of a 10 wt % solution prepared by diluting an acrylic resin obtained by mixing, boiling and polymerizing 44 wt % of the ester methacrylate, 1 wt % of benzoyl peroxide and 55 wt % of methyl ethyl ketone with butyl carbinol acetate.

Incidentally, like reference numerals are used throughout the drawings to identify like constituents.

In accordance with the present invention described above, the film is formed between the adjacent portions of the helical coated wire in the vertical direction by covering all of the heater of the double helical structure wherein the heater core wire is coated with the insulating layer, by the film which can be removed by heating. Since the adjacent portions of the coated wire in the vertical direction are supported with a suitable level of force in this manner, no variance occurs between the adjacent portions even if any external force acts on them and hence no peculiar stress develops in the heater, either. Accordingly, since no crack occurs in the insulating layer, the insulation characteristics are bit deteriorated between the heater and the cathode sleeve. Furthermore, since any clogging of the electron beam aperture of the shadow mask due to the particles of the insulating layer falling off from the cracks does not occur, a heater for an indirectly-heated cathode having high reliability can be obtained.

What is claimed is:

1. In a heater for an indirectly-heated cathode having a double helical structure wherein a heater core wire is coated with a sintered insulating layer, a heater for an indirectly-heated cathode characterized in that a protective film which can be removed by heating is formed on said sintered insulating layer and extending at least between the adjacent portions in a vertical direction, of said core wire coated with said sintered insulating layer in said helical structure.

2. A heater for an indirectly-heated cathode according to claim 1, wherein said film is made of a material which can be removed by heating from 250° to 350° C. for 2 to 4 minutes.

3. A heater for an indirectly-heated cathode according to claim 1, wherein said film which can be removed by heating is made of an organic resin or a material containing said organic resin as its principal component.

4. A heater for an indirectly-heated cathode according to claim 3, wherein said organic resin is nitrocellulose.

5. A heater for an indirectly-heated cathode according to claim 3, wherein said organic resin is polyvinyl alcohol.

6. A heater for an indirectly-heated cathode according to claim 3, wherein said organic resin is an acrylic resin obtained by polymerizing methylester methacrylate, benzoyl peroxide and methyl ethyl ketone.

7. A heater for an indirectly-heated cathode according to claim 1, wherein said film which can be removed by heating is from 3 μm to 50 μm thick.

* * * * *